United States Patent [19]

Emberson

[11] Patent Number: 4,746,836

[45] Date of Patent: May 24, 1988

[54] FLAT CATHODE RAY DISPLAY TUBE

[75] Inventor: David L. Emberson, Kenley, England

[73] Assignee: U.S. Philips Corp., New York, N.Y.

[21] Appl. No.: 29,841

[22] Filed: Mar. 24, 1987

[30] Foreign Application Priority Data

Apr. 25, 1986 [GB] United Kingdom ..... 8610226

[51] Int. Cl.[4] ..... H01J 29/48; H01J 29/86

[52] U.S. Cl. ..... 313/422; 313/160

[58] Field of Search ..... 313/422, 402, 160

[56] References Cited

U.S. PATENT DOCUMENTS 4,180,760 12/1979 Chang ..... 313/422

4,622,490 11/1986 Benway ..... 313/402

*Primary Examiner*—David K. Moore

*Assistant Examiner*—K. Wieder

*Attorney, Agent, or Firm*—Thomas A. Briody; Jack Oisher

[57] ABSTRACT

A flat cathode ray display tube in which an electron beam (30) is directed firstly in a rear region (24) parallel to a faceplate (14) carrying a phosphor screen (16) and then reversed to travel in the opposite direction in a front region (22) before being deflected towards, and raster scanning over, the screen. A magnetic shield (60) is provided in the rear region to shield the beam from magnetic fields entering through the faceplate over a portion of its path length in that region to reduce raster shift effects caused by such fields. This is especially useful when the electron beam in the front and rear regions is a low-energy beam, rendering it particularly susceptible to influence by magnetic fields, such beam being supplied to an electron multiplier (44) overlying the screen.

7 Claims, 2 Drawing Sheets

FLAT CATHODE RAY DISPLAY TUBE

BACKGROUND OF THE INVENTION

1. Field of the Invention

This invention relates to a flat cathode ray display tube comprising an envelope including a substantially flat, transparent, faceplate carrying a phosphor screen, means for producing an electron beam and directing the beam parallel to the faceplate through a first region towards a reversing lens which turns the beam so that it travels in the opposite direction parallel to the faceplate through a second region, first deflection means intermediate the electron beam producing means and the reversing lens for deflecting the beam in a plane substantially parallel to the faceplate to effect line scanning, and second deflection means in the second region for deflecting the electron beam toward the screen, and operable to effect field scanning.

2. Description of the Related Art

A flat cathode ray display tube of this kind is described in British Patent Specification No. 2101396. In this tube, the envelope consists of a shallow, generally rectangular, metal can with a flat glass faceplate constituting the display window mounted on the can. An electron gun in the rear region of the envelope produces a low energy electron beam which is deflected linewise by an adjacent electrostatic deflection arrangement before passing to the reversing lens. After having been reversed through 180°, the beam undergoes field scanning by means of a plurality of selectively energised, vertically spaced, horizontally elongate electrodes arranged in a plane parallel with the faceplate in the front region of the envelope and is deflected thereby towards a phosphor screen carried on the faceplate onto the input side of a channel electron multiplier disposed parallel to, but spaced from, the screen. Thus, the line and field scanned beam provides a raster scanning electron input to the electron multiplier. Having undergone current multiplication within the electron multiplier, the electron beam is accelerated onto the phosphor screen by means of a high voltage field established between a backing electrode on the screen and the output side of the electron multiplier to produce a raster-scanned display picture.

An advantage in using an electron multiplier in this manner is that the multiplier in effect separates the scanning function of the electron beam from the light-generating process. The electron beam, prior to reaching the multiplier, need only be of low energy so that the beam forming and raster scanning section of the tube operates at low voltage and current compared with the high voltage, higher current screen output section. The term "low energy" used herein is intended to signify an electron beam of less than 2.5 KeV and typically several hundred electron volts. For example, a low voltage, low current beam having an acceleration voltage of around 600 V may be used. The electron multiplier amplifies the beam current with the amplified current, on leaving the multiplier, being accelerated across a short gap to the screen to produce the power necessary to generate the light output. The low energy and low current electron beam used in the beam forming and raster scanning section of the tube can easily be deflected through large angles without undue enlargement of the spot. This enables the kind of folded electron optical system described to be employed with the result that a comparatively compact, and shallow, display tube is obtained.

However, it has been found that, as a result of the use of a low energy electron beam in the beam forming and raster scanning section of the tube and the long trajectory of the beam in that section, the tube is more sensitive to ambient magnetic fields, for example the Earth's magnetic field, than a conventional display tube using a high voltage beam. Ambient magnetic fields penetrating this section of the tube can, for example, influence the direction and position of the beam before it reaches the reversing lens producing a deviation from the intended path of the beam through the reversing lens.

The metal can of the tube's envelope affords some magnetic shielding. In addition, an external magnetic shield comprising a box of mumetal material can be fitted around the tube's envelope, but not, of course covering the faceplate. Where Hx, Hy, and Hz designate magnetic field components along three mutually perpendicular axes, x, y, and z, extending respectively parallel to the line deflection direction (i.e. perpendicular to the output beam of the gun and parallel to the faceplate), parallel to the axis of the electron gun (i.e. parallel to the output beam of the gun and the faceplate), and perpendicular to the plane of the faceplate such an external magnetic shield can reduce the susceptibility to the Hx and Hy components to a sufficient level to allow operation of the tube at any orientation with respect to, for example, the Earth's magnetic field without serious effect.

The practical limit of this shielding is determined by the leakage of the external magnetic field through the faceplate. This leakage is greatest for the Hz component. The Hz component entering through the faceplate can result in a shift of the raster along the x direction, parallel to line scan direction. In a tube having a screen of approximately 120 mm (field height) by 160 mm (line width), a maximum electron beam trajectory of approximately 350 mm and a beam voltage of 600 V, this shift in the x direction may be, for an Hz component measured in Amperes/meter around 0.13 to 0.19 mm per Ampere/meter. Whilst this shift in the position of the raster on the screen can be tolerated and electronically corrected for static applications, it becomes more significant when the tube is used in a mobile environment.

SUMMARY OF THE INVENTION

It is an object of the present invention to provide a flat cathode ray display tube of the kind mentioned in the opening paragraph in which the above-described effect on the operation of the tube caused by an ambient magnetic field having an $H_z$ component is at least significantly reduced.

According to the present invention, there is provided a flat cathode ray display tube of the kind mentioned in the opening paragraph which is characterised in that the tube includes means within the envelope for magnetically shielding a part only of the electron beam path in the first region over a predetermined distance.

It has been found that by providing this magnetic shielding means the shift in the x direction of the raster caused by the Hz component of an external magnetic field is significantly reduced and becomes practically negligible. The reason for this is as follows. The principal effect of the interaction of this Hz component with the y-velocity component of the beam is to deflect the raster in the x direction. However, the reversal of the y-velocity component of the beam by the reversing lens between the first region (the input to the reversing lens) and the second region (the output from the reversing lens) leads to some mutual cancellation of the deflection as the forces acting on the beam in the x direction in those two regions are in opposite senses. However, in the known tube, the net deflection within the confines of the tube generally remains in one direction only relative to the undeflected (zero magnetic field) situation but varies over the height of the raster, i.e. the vertical position of the beam in the raster. By providing the magnetic shielding means in accordance with the invention, the point at which this mutual cancellation in deflection occurs is shifted to a position overlying the screen so that, over at least a certain area of the screen, the residual, net, deflection is minimal.

The magnetic shielding means preferably extends from adjacent the end of the electron beam producing means remote from the reversing lens towards the reversing lens. This ensures that the formation of a properly focussed and directed beam is not impaired by the magnetic field component Hz. Typically, the length of the shielding means will be such that the line deflection means will be shielded as well so that operation of this deflection means can take place unaffected by the field component Hz. Also, because the only portion of the first region which is subjected to the field component Hz is then confined to that portion nearest the reversing lens, the actual amount of displacement of the electron beam from its intended path caused by the component Hz at the entry of the reversing lens is kept to a minimum.

Theoretical analysis of a simplified model of a completely unscreened tube has been made to predict the x-direction shift to be expected. For the purpose of this analysis it was assumed that the magnitude of the velocity of the electron beam throughout both the first and second regions is constant and equal to 600 V energy. The reversal of the velocity vector by the reversing lens means that the transverse (x direction) force generated by interaction of the y velocity component and the Hz field component acts in opposite directions in the two regions. Mathematically, the problem can be equated to the situation where the velocity remains constant and the magnetic field is reversed after a certain time, this time being the transit time in the first region from the point of beam formation to the input of the reversing lens. Calculations show that $$Xy = \mu o \cdot \frac{e}{m} \cdot \sqrt{\frac{m}{2eVa}} \cdot Hz\left(-y_1^2 + 2y_1y - \frac{y}{2}\right)$$

where:

Xy is the displacement in meters of the beam in the x direction at a point where y is the total distance travelled by the beam in meters; $y_1$ is the distance in meters between the point of beam formation and the reversing lens; Hz is the magnetic field component, assumed uniform, measured in Amperes/meter; Va is the voltage of the electrons and e and m are respectively the charge and mass of the electrons.

The distance, y, at which the net resultant deflection is zero is given by $$-y_1^2 + 2y_1y - \frac{y^2}{2} = 0 \text{ which is satisfied by } y = (2 + \sqrt{2})y_1.$$

Thus, for a completely unscreened tube, the initial x direction deflection in the first region is exactly cancelled when the trajectory of the beam in the second region is $(1+\sqrt{2})$ times that of the trajectory of the beam in the first region. In actual practice, because of screening by the tube structure, for example, its metal can, and/or an external magnetic shield if used, the magnetic field in the first and second regions will not generally be identical so that the length of the trajectory in the second region to the point where the deflections in the first and second regions cancel out will differ slightly from the above theoretical figure. Even so, in tubes of the aforementioned known kind the cancellation point will normally be beyond the limit of the display screen because of the nature of the electron optic system employed.

The invention is based on the recognition of the fact that this apparent limitation can be overcome to some extent by changing the effective value of $y_1$ so that the point at which deflections are cancelled out is displaced. By providing the magnetic shielding means according to the invention, with the said part of the beam path in the first region being screened from the influence of the Hz field component, only the remaining, unshielded, part of the path in that region extending from the end of the magnetic shielding means nearest the reversing lens to the reversing lens is subject to influence by Hz and the total amount of deflection in the first region caused by Hz is therefore reduced. Thus $y_1$ in effect becomes the length of that unshielded part of the beam path, rather than the total length of the beam path in the first region, and the point of deflection cancellation in the second region is moved in a direction towards the reversing lens because cancellation now occurs within a shorter distance.

More specifically, if the shielded length of the beam trajectory in the first region is carefully selected taking into account the expected magnetic fields in both the first and second regions (which will not necessarily be the same), the point where the opposed deflections created in the first and second regions by the magnetic field can be controlled and brought to a place overlying the screen. Preferably, the magnetic shielding means is arranged to shield the beam path over a distance in the first region such that the length of the path of the beam from the reversing lens to a selected point overlying the screen in the second region is equal approximately to $(1+\sqrt{2})$ times the length of the path of the beam in the first region from the end of the magnetic shielding means nearest the reversing lens to the reversing lens. In so doing, the extent of raster shift across the screen is significantly reduced. Advantageously, this selected point of cancellation is positioned near the centre of the display screen so that, although net deflections will still be present towards opposite ends of the display area, (i.e. the ends nearest to and remote from the reversing lens), the extent of these residual deflections will be minimised with the central region of the display area being substantially free from net deflection. In effect, the raster shift is reduced to that arising from a trajectory length approximately to one half of the picture field length. In practice, it has been found that this can result in a reduction of the raster shift to about one-seventh of that of a completely unshielded tube.

In a preferred embodiment, the magnetic shielding means completely surrounds the said part of the electron beam path and comprises a tubular structure formed of magnetic shielding material, for example, a magnetic alloy such as mumetal or a permalloy material which are magnetically soft and have a high permeability. Advantageously, the tubular structure has two substantially flat opposing surfaces parallel with the plane of the faceplate and sloping side walls between those surfaces. In this way, any local distortion of the Hz field component in the adjacent part of the second region caused by the magnetic shielding means is minimised.

BRIEF DESCRIPTION OF THE DRAWINGS

A flat cathode ray display tube in accordance with the present invention will now be described, by way of example, with reference to the accompanying drawings in which.

DESCRIPTION OF THE PREFERRED EMBODIMENTS

Figure 1:
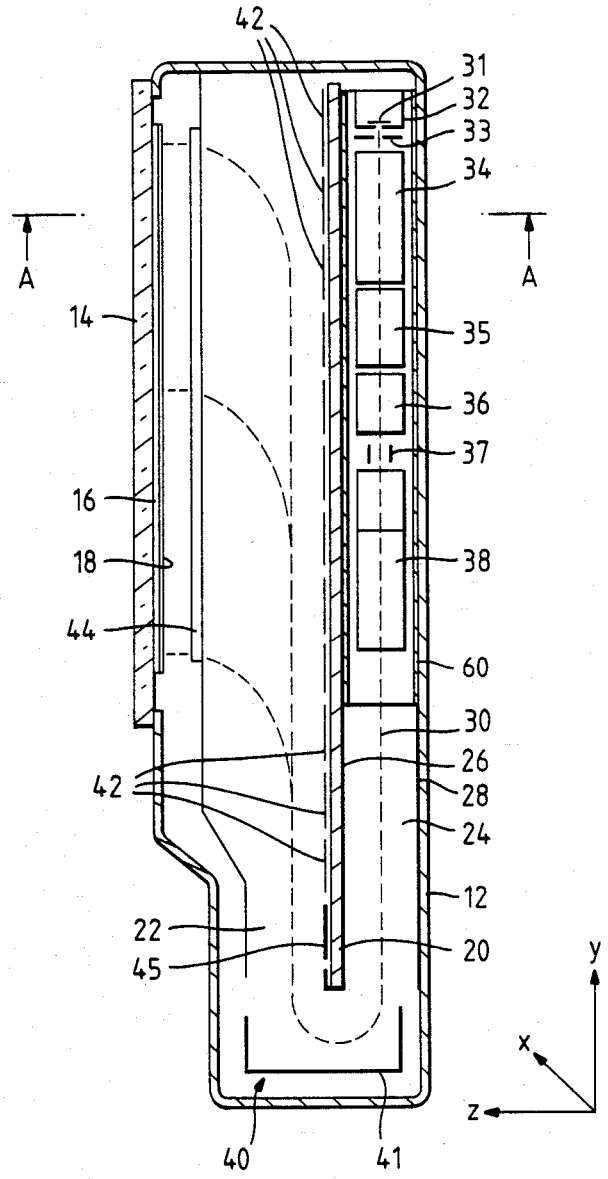
FIG. 1 is a schematic cross-sectional view through the tube.
Figure 2:
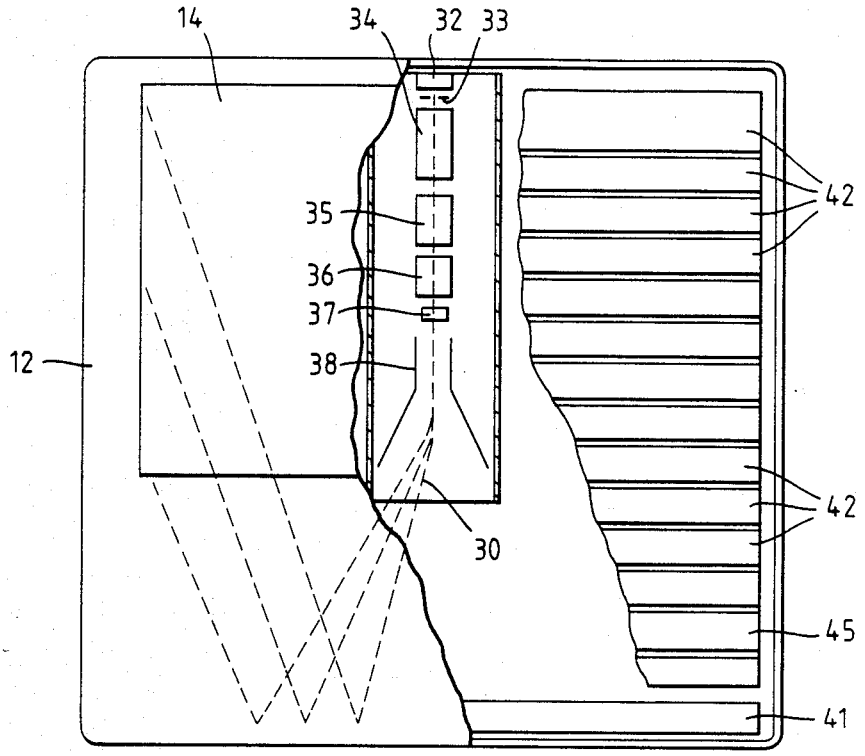
FIG. 2 is a diagrammatic plan view of the tube partly broken away to show certain components and illustrating in particular typical electron beam trajectories during operation.

Referring to FIGS. 1 and 2, the cathode ray display tube comprises a generally flat-walled rectangular envelope 12 including a substantially flat, glass faceplate 14, the remaining walls being formed of an alloy of matching expansion coefficient. Carried on the inside surface of the faceplate 14, there is a screen comprising a layer 16 of phosphor material covered by an aluminium backing electrode 18.

The interior of the envelope 12 is divided in a plane parallel to the faceplate 14 by an internal partition 20 to form a front region 22 and a rear region 24. The partition 20, which comprises an insulator such as glass, extends over a major part of the height of the tube.

A planar electrode 26 is provided on a rear side of the partition 20. This electrode 26 extends over the lower, exposed, edge of the partition and continues for a short distance up its front side. The rear wall of the envelope is provided on its internal surface with an electrode 28 facing the electrode 26.

Means for producing a low-energy electron beam is situated in the rear region 24. The electron beam producing means is arranged to direct an electron beam 30 downwardly of the tube parallel to the faceplate 14 and comprises an electron gun having a heated cathode 31, an apertured grid electrode 32, an object forming apertured grid electrode 33, an acceleration electrode 34, a focussing electrode 35 and a final acceleration (anode) electrode 36.

A downwardly directed electrostatic line deflector 38 is spaced by a short distance from the final anode 36 of the electron gun and is arranged coaxially therewith. In operation, the line deflector 38 deflects the beam 30 in a plane parallel with the faceplate 14 to effect line scanning. Situated between the final anode 36 and the line deflector 38 are a pair of alignment electrodes 37, one on each side of the beam path.

At the lower end of the envelope 12, there is a reversing (mirror) lens 40 comprising a trough-like electrode 41 which is spaced below and disposed symmetrically with respect to the lower edge of the partition 20. By maintaining a potential difference between the electrodes 26 and 41 the electron beam 30 is reversed through 180° so as to travel in the opposite direction in the front region 22 over the front side of the partition 20 whilst continuing along the same angular path from the line deflector 38.

On the front side of the partition 20 there is provided a planar deflection electrode arrangement. This arrangement comprises a plurality of laterally elongate, vertically spaced electrodes of which the lowermost electrode 45 may be narrower and acts as a correction electrode as will be described. The others of such electrodes, 42, are selectively energised to provide frame deflection of the electron beam 30 onto the input side of a glass micro-channel plate electron multiplier 44 extending parallel to, and spaced from, the screen 16. The multiplier 44 has a matrix of channels of, say, 12 μm diameter and 15 μm pitch. Other forms of channel plate electron multipliers, such as a laminated metal dynode electron multiplier, may be used instead. The electron beam, having undergone current multiplication within the multiplier 44, is then accelerated onto the phosphor screen 16 to produce a display by means of a high voltage accelerating field established between the screen electrodes 18 and the output surface of the multiplier 44.

In operation of the display tube, the following voltages are, for example, applied with respect to the cathode 31 potential of 0 V. The final anode 36 of the electron gun is held at 600 V giving an electron beam voltage of 600 V. The electrodes 26 and 28 in the rear region 24 are also held at 600 V whilst line deflection is accomplished by applying in regular fashion potential changes of about ±60 V around a mean of 600 V to the plates of the line deflector 38. The trough-like electrode 41 of the reversing lens is at 0 V, compared to the 600 V of the extension of the electrode 26 over the bottom edge of the partition 20, to reflect the beam 30 through 180°. The input surface of the multiplier 44 is at 600 V whilst at the beginning of each frame scan the electrodes 42 are at 600 V, but are subsequently ramped down to 200 V in turn, so that the electron beam 30 in the front region 22 is initially deflected into the uppermost channels of the multiplier 44 and then progressively moves downwardly over the multiplier, the point of deflection being determined by the next electrode 42 in the array to be at 200 V. Using overlapping waveforms applied to the electrodes 42, vertical scanning is achieved smoothly.

The voltage across the multiplier is typically about 1400 V. The screen electrode 18 is typically at about 14 kV to provide the necessary acceleration for the beam onto the phosphor screen 16.

It is seen therefore that the line deflector 38 and deflection electrodes 42 are responsible for scanning the low energy beam from the electron gun over the input surface of the multiplier 44 in raster fashion. In order to carry out a rectangular raster scan, it is necessary to provide a trapezium correction to the linescan by applying dynamically a correction to the line deflector 38.

As mentioned previously, the electrode 41 is arranged symmetrically with respect to the partition 20. The electrode is at a suitable distance from the partition's edge so that the beam, having been deflected through 180° remains substantially parallel in the front region 22. As a precaution against misalignment however, which would lead to the beam 30 not emerging parallel to the plane of the screen, a correction voltage can be applied to the correction electrode 45 to adjust the exit angle.

In a similar manner, the pair of alignment electrodes 37 are provided for deflecting the path of the beam 30 in a plane perpendicular to the screen as it leaves the electron gun in order to counteract any misalignment of the gun and to ensure that the beam path is substantially parallel with the screen 16 and enters the reversing lens at the optimum height.

The display tube described thus far is similar in many respects to that described in British Patent Specification No. 2101396, details of which are incorporated herein by reference. For a more detailed description of the operation of the tube, reference is invited to this specification.

In the event of the tube being subjected to ambient magnetic fields, unwanted deflection of the electron beam 30 can occur in the regions 22 and 24. To simplify the following description it is assumed that the magnetic fields have components Hx, Hy and Hz in x, y and z directions where x, y and z are, as shown in FIG. 1, mutually orthogonal axes extending respectively parallel to the line deflection direction and the screen 16, parallel to the axis of the electron gun and perpendicular to the x axis and the plane of the screen 16.

The Hy component may result in a small movement of the raster in the x-direction arising from the interaction of the Hy component and the z-velocity component of the beam in its transit through the reversing lens 40 and the frame deflection region. For most practical situations the amount of raster shift caused by this component will, in the case of the Earth's magnetic field for example, be negligible.

Interaction between the Hx component and the y-velocity component of the electron beam deflects it in the z-direction. The pair of alignment electrodes 37 and the correction electrode 45 may be utilised to counteract the result of this interaction. A magnetic shield of mumetal material placed around the outside of the envelope 12, except for the faceplate 14 which is left uncovered, has been found to reduce susceptibility to the Hx and Hy components significantly. This reduction is sufficient to allow operation of the tube at any orientation to the Earth's magnetic field without requiring adjustment to the voltages applied to the alignment electrodes 37 and the corrector electrode 45.

The principal effect of the Hz component is the interaction of this component with the y-velocity component of the electron beam causing a shift of the raster in the x-direction. An external magnetic shield around the tube's envelope allows leakage of the ambient magnetic fields through the necessary window therein overlying the tube's faceplate which is greatest for the Hz component. Typically, this shift of the raster will be of the order of 0.13 to 0.19 mm per Ampere/meter for a beam having a total path length of 350 mm and accelerated through 600 V.

In order to suppress, at least to some extent, the effects of an Hz magnetic field component and reduce the amount of raster shift caused thereby to an acceptable level, the display tube is, in accordance with the invention, provided with magnetic shielding means within the tube's envelope for magnetically shielding a predetermined part of the electron beam path in the rear region 24. With reference to FIGS. 1 and 2, this shielding, designated 60, extends from adjacent the point of actual beam formation determined by the object grid 33 towards the reversing lens 40.

The forces acting on the electron beam 30 in the x-direction as a result of the existence of an Hz magnetic field component are reversed between the front and rear regions 22 and 24 by virtue of the reversal of the y-velocity component of the beam by the reversing lens 40. Thus the initial x-velocity of the beam in the rear region 24 produced by the Hz field component in that region is progressively cancelled as the beam traverses the same field component in the front region 22 and is ultimately reversed. The resulting x-direction deflection thus continues initially to increase after passage through the reversing lens 40 despite the reversal of the y-velocity, reaches a maximum, and thereafter reduces to zero before increasing in the opposite direction. For a tube without the internal magnetic shielding means, the point at which the deflection would be substantially cancelled lies beyond the confines of the tube.

In providing magnetic shielding means for shielding a part of the beam trajectory in the rear region 24, the point in the front region 22 at which deflection cancellation occurs is displaced towards the reversing lens 40 as a result of interaction between the Hz component and the beam in the rear region 24 being confined to that length of the portion of the beam path in the rear region 24 which remains unshielded. Thus the affected length of the beam path in the rear region 24, i.e. the part of the path subject to the influence by Hz, is reduced which results in a corresponding reduction in the overall extent of deflection caused by Hz in the region 24. Accordingly, this reduced deflection can be cancelled over a shorter length in the y-direction of the beam trajectory in the front region 22.

By varying the length of the part of the beam path in the rear region which is shielded, and consequently the part which remains unshielded, the point in the front region where the deflections in opposite senses cancel one another out can be controlled. In the present embodiment, the magnetic shielding means is arranged to shield the beam over a distance in the rear region 24 selected such as to position the point of cancellation approximately at the centre, field-wise, of the display screen 16. In this way, the amount of raster shift caused by the Hz component across the entire field height of the display is minimised. In effect, the raster shift is reduced to that arising from at trajectory length approximately to one half of the picture height. In the flat tube described this results in a reduction of the shift to about 1/7th of that of a completely unscreened tube. By way of example for a tube in which the distance in the y-direction between the point of beam reversal in the reversing lens 40 to the centre of the screen height is 130 mm, the magnetic shielding means is arranged to shield the beam path in the rear region 24 such that the length in the y-direction of the remaining unshielded path in that region between the end of the shielding means and the point of beam reversal is 55 mm, which is approximately 130 divided by $(1+\sqrt{2})$. In order to locate the cancellation point exactly at the centre of the screen, it is necessary also to take into account such factors as the effects of the tube's structure, for example its metal envelope, on the magnetic field which is likely to result in the Hz values in the front and rear regions being different.

Figure 3:
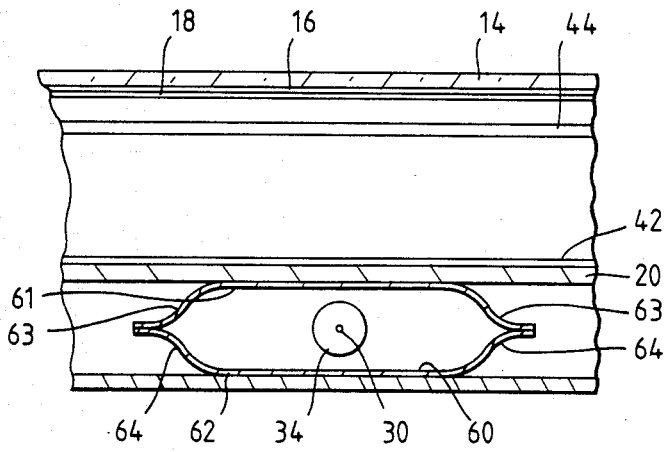
FIG. 3 is a schematic, cross-sectional view through a portion of the tube along the line A—A of FIG. 1.

The magnetic shielding means 60 comprises an open-ended tubular structure of mumetal material disposed between the partition 20 and the rear wall of the tube's envelope 12. This tubular structure completely surrounds the electron beam 30 over a predetermined portion of the length of its path in rear region 24. In the embodiment shown in FIGS. 1 and 2, the tubular structure encloses the electron gun, comprising components 31 to 36, the pair of alignment electrodes 37 and the line deflector 38. Referring especially to FIG. 3, the tubular structure of the magnetic shielding means is arranged symmetrically with respect to the beam 30 and has flat upper and lower surfaces 61 and 62 extending parallel to the faceplate 14, and over a width sufficient to accommodate the plates of the line deflector 38. The sides of the tubular structure each consist of two outwardly directed and mutually-inclined side-wall sections 63 and 64 which are joined together along respective outwardly-projecting lips. The edges between the surfaces 61 and 62 and the sections 63 and 64 and between the sections 63 and 64 and their lips are smoothly curved. The purpose of the angled sides of the structure and the smoothly curved edges is to minimise any local distortion of the Hz field in the front region 22.

I claim:

1. A flat cathode ray display tube comprising an envelope including a substantially flat, transparent, faceplate carrying a phosphor screen, means for producing an electron beam and directing the beam parallel to the faceplate through a first region towards a reversing lens which turns the beam so that it travels in the opposite direction parallel to the faceplate through a second region, first deflection means intermediate the electron beam producing means and the reversing lens for deflecting the beam in a plane substantially parallel to the faceplate to effect line scanning, and second deflection means in the second region for deflecting the electron beam toward the screen and operable to effect field scanning, characterized in that the tube includes means within the envelope for magnetically shielding a part only of the electron beam path in the first region over a predetermined distance.

2. A flat cathode ray display tube according to claim 1, characterised in that the magnetic shielding means is arranged to shield a part of the beam path in the first region extending from adjacent the end of the electron beam producing means remote from the reversing lens towards the reversing lens.

3. A flat cathode ray display tube according to claim 2, characterised in that the magnetic shielding means is arranged to shield the beam path over a distance in the first region such that the length of the path of the beam from the reversing lens to a selected point overlying the screen in the second region is equal to approximately $(1+\sqrt{2})$ times the length of the path of the beam in the first region from the end of the magnetic shielding means nearest the reversing lens to the reversing lens.

4. A flat cathode ray display tube according to claim 3, characterised in that the selected point overlying the screen is approximately at the centre of the screen.

5. A flat cathode ray display tube according to claim 1, characterised in that the magnetic shielding means completely surrounds the part of the electron beam path in the first region and comprises a tubular structure formed of magnetic shielding material.

6. A flat cathode ray display tube according to claim 5, characterised in that the tubular structure has two substantially flat opposing surfaces disposed parallel with the plane of the faceplate and sloping side walls between those surfaces.

7. A flat cathode ray display tube according to claim 1, characterised in that the electron beam in the first and second regions is a low energy electron beam and in that the tube further includes an electron multiplier arranged substantially parallel with the plane of the faceplate between the screen and the second deflection means.

* * * * *